US007809324B2

(12) United States Patent
Josefsberg

(10) Patent No.: US 7,809,324 B2
(45) Date of Patent: Oct. 5, 2010

(54) METHOD AND APPARATUS FOR DETERMINING THE EFFICIENCY OF RADIO PUBLICITY AND/OR BROADCASTED PROGRAMS

(75) Inventor: Yekutiel Josefsberg, Herzlia (IL)

(73) Assignee: Future Wireless Ltd., Herzlia (IL)

( * ) Notice: Subject to any disclaimer, the term of this patent is extended or adjusted under 35 U.S.C. 154(b) by 634 days.

(21) Appl. No.: 10/597,171

(22) PCT Filed: Jan. 13, 2005

(86) PCT No.: PCT/IL2005/000052

§ 371 (c)(1),
(2), (4) Date: Jan. 3, 2007

(87) PCT Pub. No.: WO2005/067386

PCT Pub. Date: Jul. 28, 2005

(65) Prior Publication Data

US 2008/0233863 A1 Sep. 25, 2008

(30) Foreign Application Priority Data

Jan. 16, 2004 (IL) ..... 159904

(51) Int. Cl.
*H04H 60/21* (2008.01)

(52) U.S. Cl. ..... 455/2.01; 455/3.06

(58) Field of Classification Search ..... 455/3.06, 455/2.01, 41.2

See application file for complete search history.

(56) References Cited

U.S. PATENT DOCUMENTS

| | | | | |
|---|---|---|---|---|
| 3,800,223 | A | 3/1974 | Mead et al. | |
| 4,618,995 | A | 10/1986 | Kemp | |
| 4,955,070 | A | 9/1990 | Welsh et al. | |
| 5,382,970 | A * | 1/1995 | Kiefl | 455/2.01 |
| 5,839,050 | A | 11/1998 | Baehr et al. | |
| 6,219,524 | B1 | 4/2001 | Stephens | |
| 6,466,765 | B1 | 10/2002 | Tanaka et al. | |
| 6,643,494 | B1 | 11/2003 | Worthy | |
| 6,813,475 | B1 | 11/2004 | Worthy | |
| 6,934,508 | B2 * | 8/2005 | Ceresoli et al. | 455/2.01 |

FOREIGN PATENT DOCUMENTS

| | | |
|---|---|---|
| WO | WO 99/62260 | 12/1999 |

* cited by examiner

*Primary Examiner*—Tu X Nguyen
(74) *Attorney, Agent, or Firm*—Marsteller & Associates, P.C.

(57) ABSTRACT

Method and apparatus for determining the efficiency of publicity and/or broadcasted programs, according to which, when a TV converter or FM radio is operated, the frequency of the broadcast channel received at the moment is determined either directly from the TV converter or FM radio display or by extracting the LO frequency of the TV converter or FM radio. The frequency is transformed to a digital word and when the information as to the amount of watching and listening of a given publicity and/or broadcasted program or publicities is desired, a request for the information is sent and when received, the memorized digital words corresponding to the frequency of the broadcast channel received at the moment is transmitted.

10 Claims, 6 Drawing Sheets

METHOD AND APPARATUS FOR DETERMINING THE EFFICIENCY OF RADIO PUBLICITY AND/OR BROADCASTED PROGRAMS

FIELD OF THE INVENTION

This invention relates to a method and apparatus for determining the efficiency of publicity and/or broadcasted program, more specifically for determining the time during which given publicity and/or broadcasted program announcements and transmissions, broadcasted by various TV and radio stations, are watched or heard by a given cross-section of persons. More particularly, the persons are either home TV watchers or radio listeners or car drivers and/or passengers, and the time that is determined is the time during which said persons watch or hear certain specific radio publicity and/or broadcasted program.

BACKGROUND OF THE INVENTION

Expenses for radio publicity and/or program broadcasted constitute a high percentage of the costs which any manufacturing and/or selling company and/or TV or radio station have to bear in order to promote sales. It is of particular interest to all of said companies to know to what extent such publicity and/or broadcasted program is successful, and a very significant indication is given by the time during which various groups of possible consumers actually hear the publicity and/or broadcasted program. Among such groups are included drivers and passengers of cars, who hear the publicity and/or broadcasted program while traveling and keeping open the radio receiver, of which all cars are provided.

All radios, at home or mounted in cars are provided with an antenna which may receive radio signals from a number of broadcasting stations. Radio signals are broadcast over specific frequencies, each defining a channel. To operate the radio receiver, one has to tune it, viz. to choose the desired channel, separate it from other channels and extract the voice and/or music carried through said channel. Tuning is done by a device with a very narrow bandwidth filter. In order to be effective, the filter operates at a fixed, low frequency called IF (Intermediate Frequency), which is standard at 10.7 MHz. The antenna is connected to the RF port of a mixer. The mixer also receives an input from an LO (Local Oscillator, generally a Frequency Synthesizer). The mixer is a device that produces sum and difference of the radio signal received and LO inputs. The LO is tuned to a certain frequency f0. Only the signal which differs from said frequency by the standard IF, which is practically 10.7 MHz, will be passed by the filter, while the others will be blocked. The sound, which is carried by the signal that has passed, is extracted, amplified, and transferred to the speaker of the radio receiver. The oscillator was tuned by means of a knob in old stages of the prior art, and still is in some cases, but in modern radios the tuning is performed by a keyboard and/or digital display.

Cable TV operates in a similar mode but in different frequencies. All channels at different frequencies come to the converter. At the converter, a similar process of LO and mixing occurs, which translates all of the frequencies to a single one, to which the TV set is tuned.

Publicity and/or broadcasted program transmitted by radio are heard to a very considerable extent during travel by car. Radio transmissions are widely listened to by drivers, whether professional or not, especially in rush hour time, on the way to work in the morning and on the way back home in the evening, so as to entertain them during journeys and reduce the danger that they may doze off. Since taxi drivers always keep their radio in operation, passengers are also exposed to the radio transmissions, whether they desire it or not. Therefore, an important slice of radio publicity and/or broadcasted program is that which is sounded by car radios.

It would be of considerable interest for companies which engage in publicity and/or broadcasted program to obtain in real time a significant index of the time during which said publicity and/or broadcasted program is heard, which on the average is an indication of the efficiency of said publicity and/or broadcasted program. However, the prior art does not include means for obtaining such an index in real time (by using the term "efficiency" it is meant to include any indication regarding the level of popularity of a radio or television program, as estimated by a poll of segments of the audience).

U.S. Pat. No. 6,643,494 B1 discloses a broadcast survey system configured to identify radio stations to which tuners are tuned. The tuners have local oscillator signals emitted therefrom. The survey system employs a method that includes generating and broadcasting a survey signal that is one of the local oscillator signals, modified to incorporate a signal identifier. This reference also discloses a method for active tuning of the survey system and another method for providing short range communication with remote transceiver to facilitate uploading and downloading of system setting and data.

WO 99/62260 discloses an audience rating system for digital television and radio, using identification codes in control streams of time-multiplexed digital transmission. When a television set or radio, monitored by said system, is turned on and tuned to a channel, and then the channel is changed, each time that it is changed an identification code for each audio, video or auxiliary digital stream of the channel, is extracted from the control stream, and recorded along with the time.

U.S. Pat. No. 3,800,223 discloses a monitor which includes one or more channels provided with a signal pass band window or slot that is swept at a constant rate but stopped when a television local oscillator signal enters the window. If the signal remains in the window for a predetermined time, the signal is counted and the sweep continued.

The aforesaid prior art patents, and in general all the publications of the prior art, as far as it is known to the applicants, do not provide companies that carry out radio publicity and/or broadcasted program with the desired information in real time as to the efficiency of the publicity and/or broadcasted program. This invention intends to provide such information by simple and inexpensive means.

More specifically, it is an object of this invention to provide a method and apparatus, applicable to a group of TV watchers and radio listeners who will agree to participate, that will permit to obtain reliable information as to the time during which specific publicity and/or broadcasted program is watched by TV watchers or heard by radio listeners, at home or in the car, whether drivers or passengers.

It is another object of this invention to obtain said information separately for specific broadcast channels.

It is a further object of the invention to obtain said information in real time.

It is a still further object of the invention to obtain said information by means of simple and inexpensive apparatus, which will not interfere with the normal operation of the TV converter or FM radio.

It is a still further object of the invention to provide a system and apparatus that will monitor all channels concurrently in real time, and not only a chosen one.

It is a still further purpose of the invention to provide a system and apparatus that will permit a very short timing of transmission and reception of signals relating to the desired information, and only by command.

It is a further object of this invention to provide such a system and apparatus that uses only licensed TV and radio channels dedicated and provided for such uses.

It is a still further object of the invention to provide such a system and apparatus that has no limits as to the detection zone or operation time and is not affected by parasitic leakage signals.

It is still further object of the invention to provide such a system not only for surveying TV and FM radio system but apply it to any other radio system installed in any kind of vehicles, cars, airplanes or boats, which might include receiver only like in TV converter or FM radio or transceiver for any kind of application, and can be AM, L-band, television sets, radar and so forth, either alone or in combination with the detection of FM stations. Moreover, the detected signal need not be LO signal generated by TV converter or FM radio only, but can be any signal generated in the car in relation the other radio system in use.

Other objects and advantages of the invention will appear as the description proceeds.

SUMMARY OF THE INVENTION

The method of the invention comprises the following steps:

a) When a TV converter or FM radio is operated, determining, either directly from the TV converter or FM radio display or by extracting the LO frequency of the TV converter or FM radio, the frequency of the broadcast channel received at the moment;

a) Transforming said frequency to a digital word;

b) When the information as to the amount of watching and listening of a given publicity and/or broadcasted program or publicities is desired, sending a request for said information;

c) When said request is received, transmitting the memorized digital words corresponding to the frequency of the broadcast channel received at the moment.

Preferably, the digital word corresponding to the frequency of the channel which is being received is memorized, the memorized digital word is constantly adjourning and, when a request is received, a reply is transmitted comprising the adjourned, memorized digital word.

Herein, when a TV or radio transmission is sounded by the TV converter or FM radio and is or can be watched or heard by persons, it is said that the transmission is listened to, though it is not certain that the occupants of the car actually pay attention to it. In other words, "watched or listened to" should be construed as meaning "being available for watching or listening". The request of information is sent by whoever controls the implementation of the method at the time in which the publicities of interest, viz. the publicities regarding which it is desired to ascertain whether they are listened to, are being transmitted. The method of the invention may be applied concurrently to acquire information as to the watching and listening of several publicities or of only one publicity and/or broadcasted program. According to a preferred embodiment of the invention, to which reference will be made hereinafter, said request of information is repeatedly sent at short intervals during the whole time in which said publicities of interest are transmitted. At each request of information a reply is given, specifying the frequency of the broadcast channel received at the moment. Said replies are processed at a processing station, which may be the base station from which the implementation of the invention is controlled, or may be another station to which the information is transferred. At the processing station a graph may be constructed wherein the time of the request is the abscissa and the said frequency is the ordinate, and said graph will show different curves, each corresponding to a given frequency. Instead of a graph, the same information may be memorized and/or expressed in digital form. In any case, the time period during which each publicity and/or broadcasted program is transmitted will be determined, and a level of rating for each publicity and/or broadcasted program can be derived from said time period data.

The invention also provides an apparatus, which comprises a TV converter or FM radio and additionally comprises the following components:

I. Means for determining the frequency of the broadcast that is being watched or heard at the moment that the apparatus is operated;

II. Means for deriving from said frequency a corresponding digital word;

III. Optionally and preferably, a memorizer for memorizing said digital words;

IV. An auxiliary transceiver for receiving said digital words and transmitting them when a request for information is received;

V. A central control station having central transceiver means for transmitting a request for information, when such information is desired, receiving the information transmitted by said auxiliary transceiver.

The invention is also directed to an apparatus that can identify the person who watches the TV or listens to the radio by means of a finger print sensor. This sensor will be provided for free to the group of persons chosen for the survey. When a person turns on the TV or the radio, or changes channel, he will be asked also to put his finger at the sensor input.

The apparatus further comprises a processing station, which is a part of or is distinguished from said central control station, for processing the replies transmitted by the auxiliary transceiver, whereby to determine from them the time period during which each publicity and/or broadcasted program is transmitted. The processing may be performed graphically or analytically, and preferably. The requests for information are sent repeatedly, with a high frequency, during the period of time in which interesting publicities or other programs are broadcasted. Correspondingly, the replies are received with the same frequency, and the processing preferably results in curves in which the frequencies of the received transmissions are plotted against time.

In such transceiver, the transmitter part may be inactive (in "stand by" mode) and does not transmit until the receiver receives a request, activates the transmitter and the digital word is then transmitted. Immediately after, the transmitter part becomes inactive again, until receiving the next request. This way, transmission time is reduced to a minimum and only when needed.

The means for determining the frequency of the broadcast are preferably chosen from the group consisting of:

1. An optical reader which reads the frequency displayed on the TV converter or FM radio;

2. An RF detector provided with an antenna, which is placed in the vicinity of the TV converter or FM radio and receives an LO signal normally emitted by the TV converter or FM radio which indicates the frequency of the current broadcast;

3. A digital interface device included in the TV converter or FM radio which receives the same digital command word setting the TV converter or FM radio to the frequency of the current broadcast station and transfers said digital word to the transceiver.

It is seen that in the first two cases the TV converter or FM radio may, though need not, be a conventional one and the remaining component of the apparatus must be added to it, while in the last case the TV converter or FM radio comprises a device that is not a standard TV converter or FM radio. The auxiliary transceiver may be a digital cellular telephone, such as is generally available to car owners, or a special transceiver such as used for car tracking or alarm systems The apparatus of the invention, with the possible exception of the TV converter or FM radio, if a conventional one is sufficient, and of a digital cellular telephone as a auxiliary transceiver, if such is used, must be supplied by whoever operates the invention (hereinafter, "the advertiser") to the car owners, who will form the group of those agreeing to implement the invention, and who may be called "the survey group members". By supplying said apparatus, the advertiser gives compensation to the survey group members who agree to implement the invention, though it is not ruled out that other compensation might be added. The cost of the apparatus is quite small in comparison with the costs involved in radio publicity and/or broadcasted program, and therefore it is worthwhile for the advertiser to supply it.

DETAILED DESCRIPTION OF PREFERRED EMBODIMENTS

Figure 1:
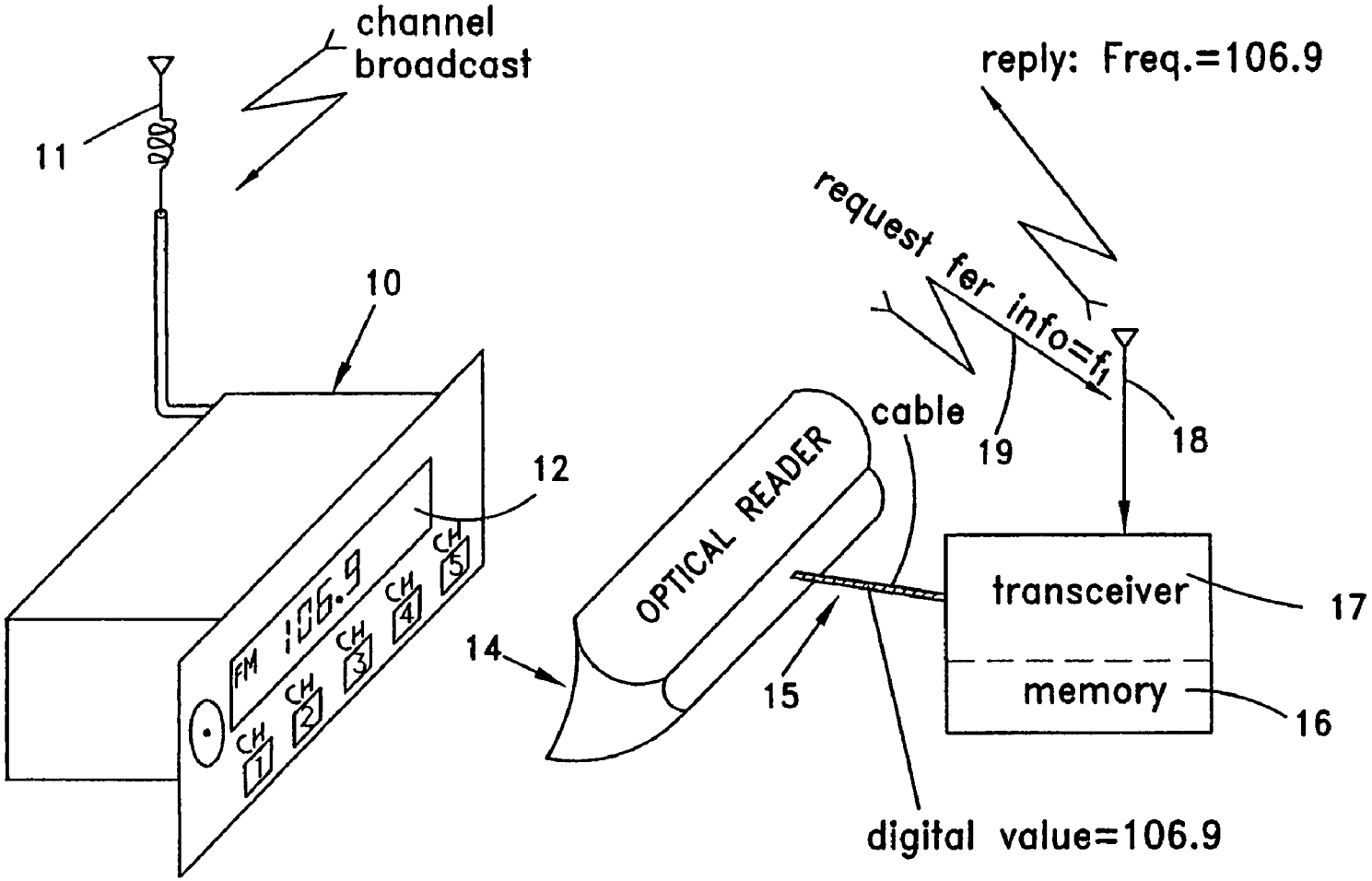
FIG. 1 is a schematic representation of an embodiment of an apparatus according to the invention, comprising an optical reader.

FIG. 1 illustrates a first embodiment of the invention. Numeral 10 generally indicates a TV converter or FM radio, provided with a signal feed cable 11 and with a display 12. A broadcast is received through said antenna and the frequency identifying said broadcast is seen on the display. In all the figures in which such display is shown, the frequency of 106.9 MHz is indicated, but this is only an example.

An optical reader 14 (in itself, a known device) reads the displayed frequency and converts it to digital value. The said digital value is transmitted, as schematically shown at 15, to a component which includes a memory 16 and an auxiliary transceiver 17. Said transceiver is provided with an antenna 18.

The invention is implemented by control personnel at a control center, not shown. When the control center desires information as to a publicity and/or broadcasted program that is being currently transmitted, it sends a request, schematically indicated at 19, and receives a reply from antenna 18.

Figure 2:
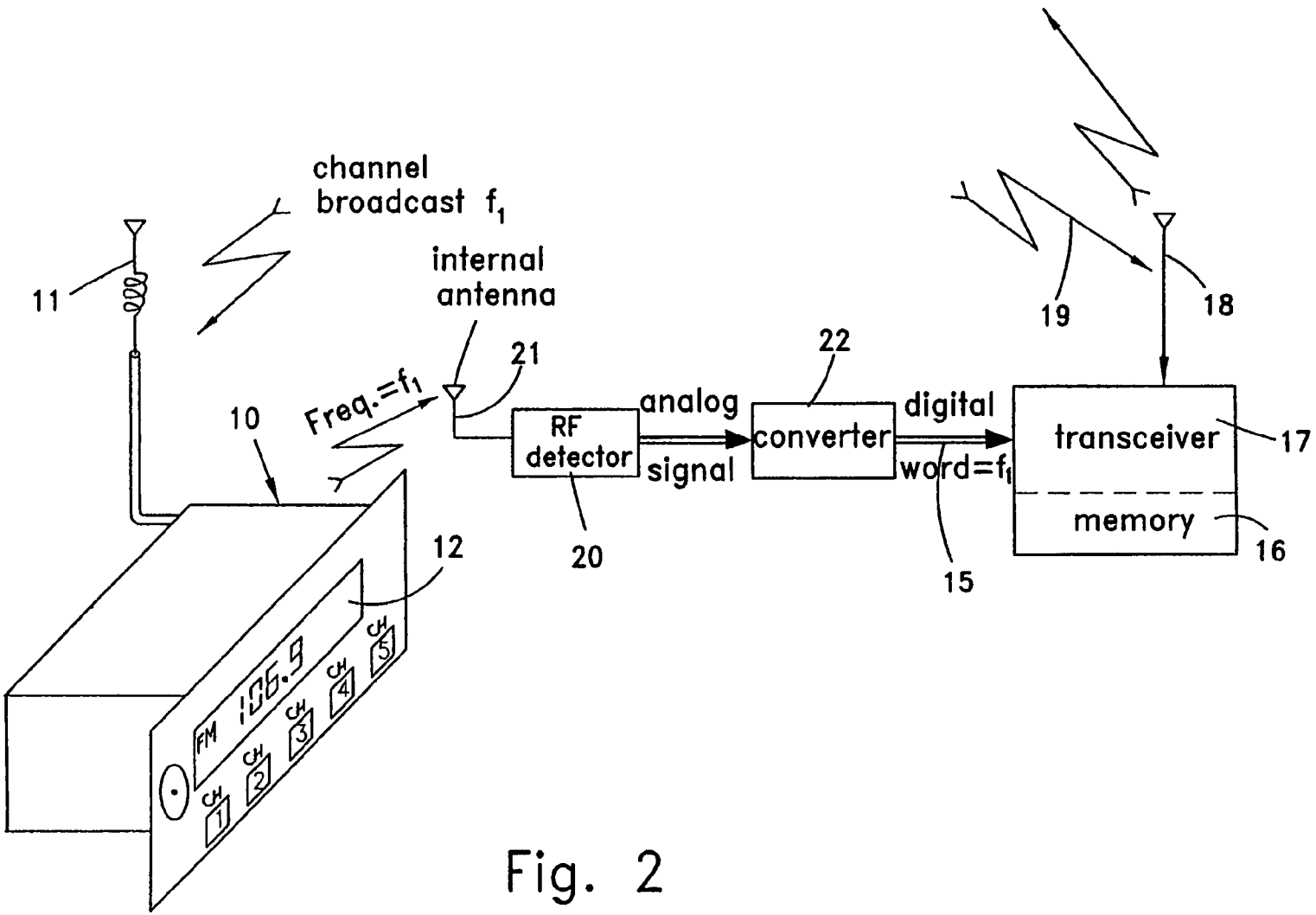
FIG. 2 is a like representation of another embodiment comprising an RF detector.

In the embodiment of FIG. 2, several components are the same as in FIG. 1 and are designated by the same numeral. However, an optical reader is not provided. An RF detector 20, provided with an internal antenna 21, is placed near the TV converter or FM radio 10. Radiation issues from the TV converter or FM radio, and is very weak but strong enough to be sensed by the RF detector, which receives an analog signal which is the LO signal, defining the frequency of the transmission being broadcast at the moment. From the RF detector, said signal is transmitted to an analog/digital converter 22, from which a digital word is transmitted, as indicated at 15, to the memory 16 and the car transducer 17.

Figure 3:
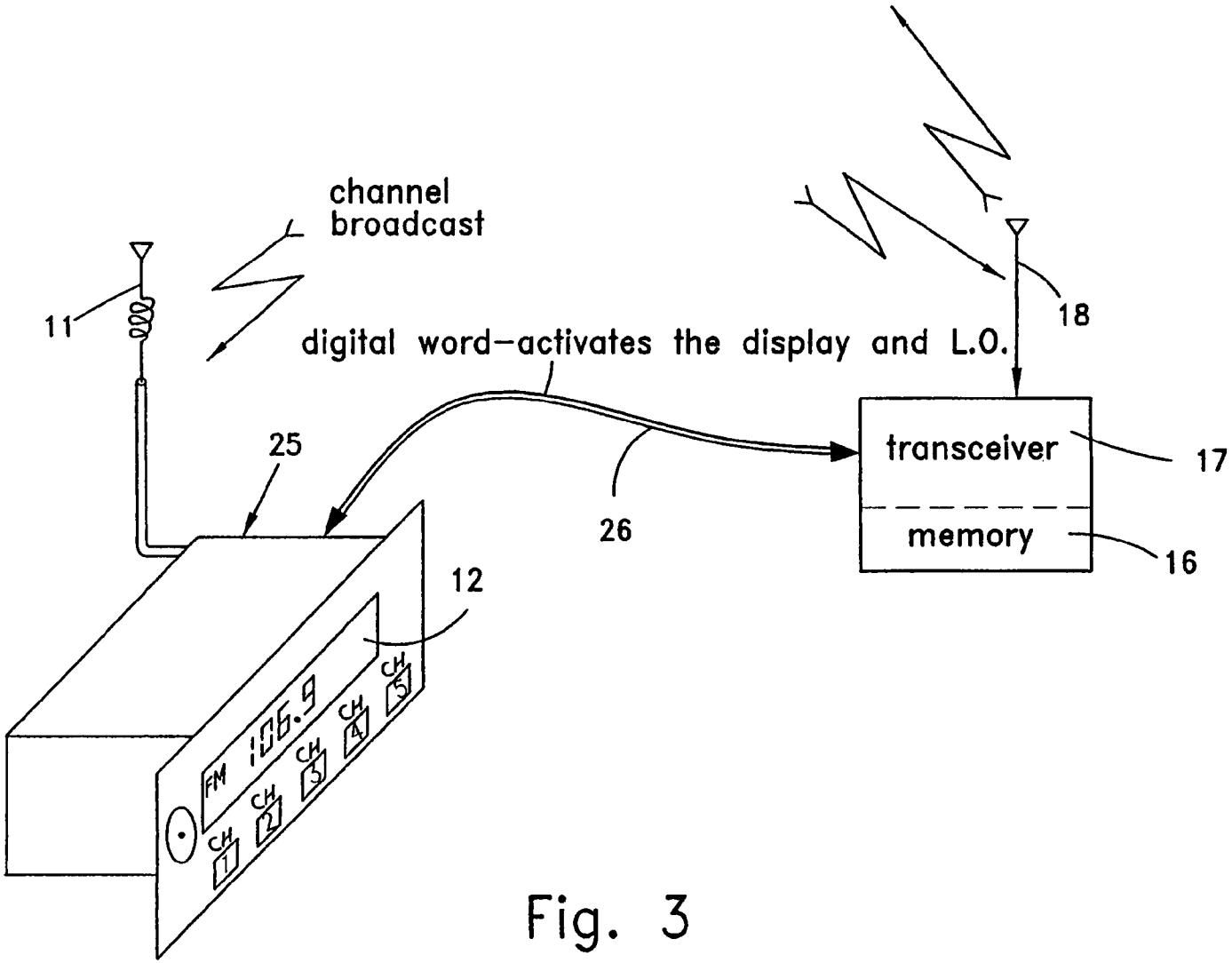
FIG. 3 is a like representation of an embodiment wherein the TV converter or FM radio includes a digital interface.

In the embodiment of FIG. 3, as well, several components are the same as in FIG. 1 and are designated by the same numeral. However, the TV converter or FM radio 25 is provided with an internal digital device, not shown, which receives and transfers the same digital control word that determines the LO frequency of the TV converter or FM radio, which is transferred, as schematically shown at 26, to memory 16 and auxiliary transceiver 17.

Figure 4:
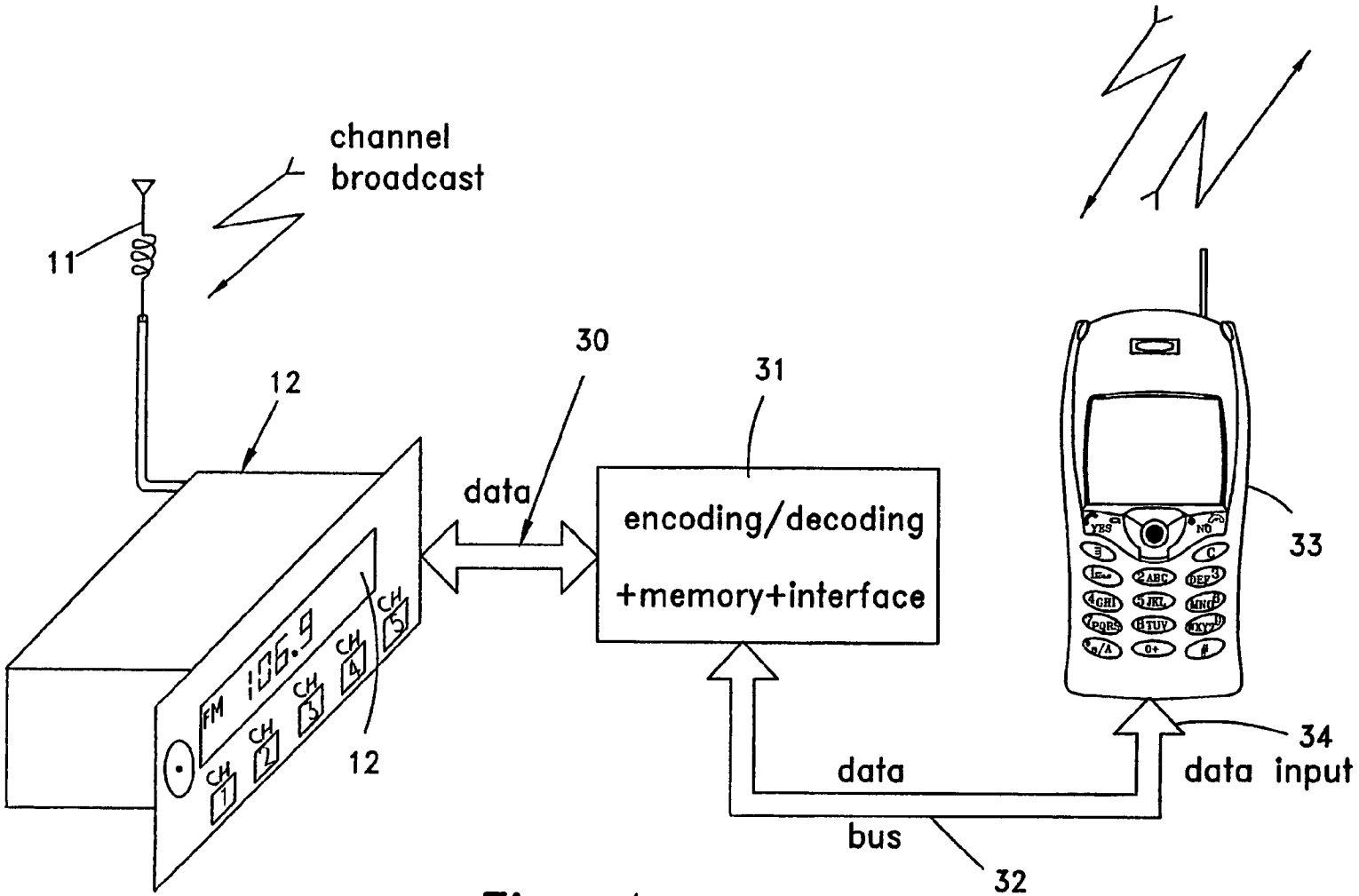
FIG. 4 is a like representation in which the transceiver is a cellular telephone.

In FIG. 4, TV converter or FM radio 10, with signal feed cable 11 and display 12, can be the same as in FIG. 1. The frequency visible on display 12 is transformed by any suitable means, not shown and which may e.g., be the same as in FIG. 1, 2 or 3 into a digital word, which is transferred, as symbolically indicated at 30, to a memory 16. However, in this embodiment, there is no auxiliary transceiver, but the data are transferred by a data bus indicated at 32 to a cellular phone 33, which is provided, as is conventional in cellular phones, with a data input, indicated at 34. The cellular phone operates like the transceiver of the previous embodiments.

Figure 5:
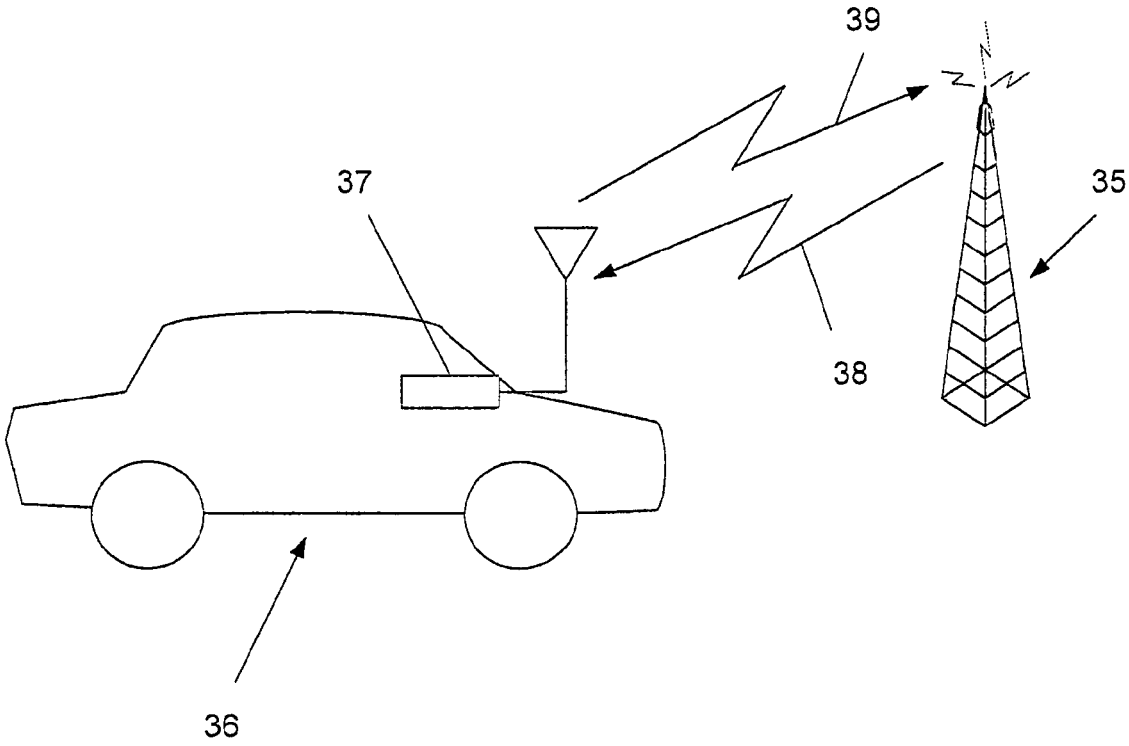
FIG. 5 is a schematic representation of the stage of requesting the information.

FIG. 5 schematically represents the relationship between a TV converter or FM radio 37 and the base station 35, from which whoever implements the invention controls the operations of the apparatus of the invention. The TV converter or FM radio and auxiliary transceiver are schematically indicated at 37. Base station 35 send requests for information as indicated at 38 to auxiliary transceiver 37 and received replies as indicated at 39. Similar arrangement is implemented for a TV converter, while the requests for information and received replies are received and transmitted over the signal feed cable 11.

Figure 6:
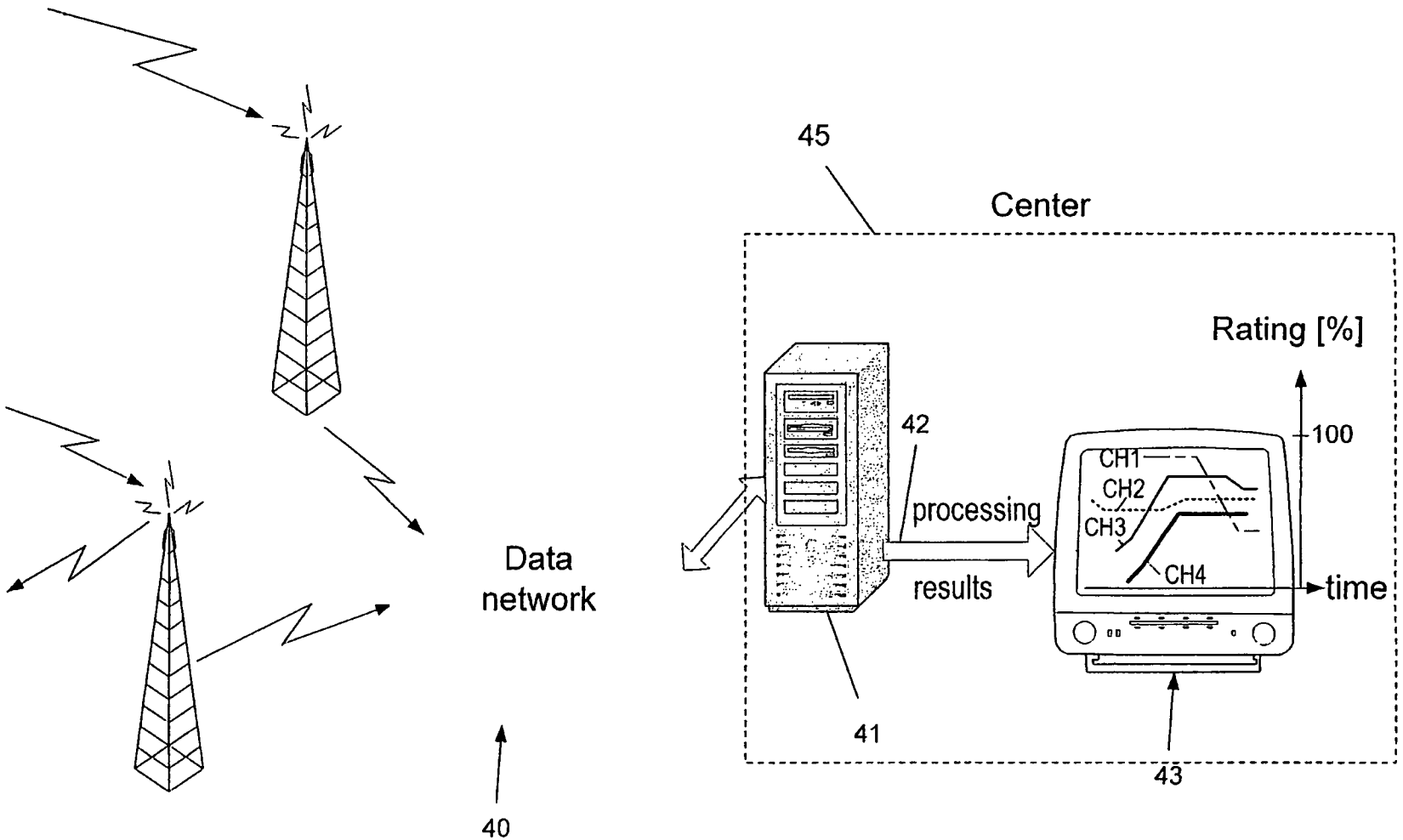
FIG. 6 is a schematic representation of the processing of the information obtained, according to an embodiment of the invention.

FIG. 6 schematically indicates the processing of the data provided by the apparatus of the invention. The network which provides the data is schematically indicated at 40. The data reaches a processing center, generally indicated at 45, which includes a processing server 41 which receives the data and processes them according to a program that is formulated by a skilled programmer as required in each case and need not be discussed herein. In this embodiment, the results are transferred at 42 to a display. The various publicity and/or broadcasted program, that are found to have been listened to, are plotted against time and the resulting curves permit to attribute to each of them a level of rating. As has been said before, a graphic display might be lacking and the data may be processed digitally.

The above embodiments have been described by way of illustration only and it will be understood that the invention may be carried out with many variations, modifications and adaptations, without departing from its spirit or exceeding the scope of the claims.

The invention claimed is:

1. Method for determining the efficiency of publicity and/or broadcasted programs, which comprises the following steps:

a) Providing frequency-determining apparatus located in the proximity of TV converter or FM radio;

b) Periodically determining the current frequency of a broadcast channel;

c) Transforming said frequency into a digital word and storing same in a memory associated with said frequency-determining apparatus; and, d) When a request is received from a remote control center, transmitting a reply which comprises the digital word stored in the memory at the time of said request.

2. Method according to claim 1, further comprising constantly adjourning the memorized digital word and, when a request is received, transmitting a reply comprising the adjourned, memorized digital word.

3. Method according to claim 1, wherein the replies are processed analytically.

4. Method according to claim 1, concurrently carried out for a plurality of publicities and/or broadcasted programs.

5. Method according to claim 1, further comprising identifying the person watching or listening to the publicities or broadcasted programs.

6. A method according to claim 1, further comprising processing the replies graphically at a control center whereby to determine from them the time period during which each publicity or broadcasted program is received in said TV converter or FM radio.

7. Apparatus for collecting data related to the efficiency of publicity and/or broadcasted programs provided to a user via a TV converter or FM radio, comprising:

i. An optical reader suitable to read the frequency displayed on the TV converter or FM radio and to convert it to a digital value;

ii. Circuitry for deriving from said frequency a corresponding digital word; and, iii. A transceiver suitable to receive said digital word and to transmit it to a specific recipient.

8. Apparatus according to claim 7, wherein the transmitter part of the transceiver is inactive and does not transmit until the receiver part of the transceiver receives a request and activates said transmitter part.

9. Apparatus according to claim 7, wherein the transceiver is a digital cellular telephone.

10. Apparatus according to claim 7, wherein the transceiver is a dedicated transceiver.

* * * * *